United States Patent [19]

Keats et al.

[11] 4,451,194

[45] May 29, 1984

[54] INTEGRAL HEEL TREE LENGTH GRAPPLE

[75] Inventors: Kevin Keats; John Kurelek, both of Brantford, Canada

[73] Assignee: Koehring Canada Limited, Brantford, Canada

[21] Appl. No.: 371,673

[22] Filed: Apr. 26, 1982

[51] Int. Cl.[3] ..... B66C 1/32

[52] U.S. Cl. ..... 414/731; 414/745; 414/738; 414/732; 294/88

[58] Field of Search ..... 414/731, 738–740, 414/745, 23, 732; 294/88, 106

[56] References Cited

U.S. PATENT DOCUMENTS 2,656,059 10/1953 Troyer ..... 414/731

3,204,795 9/1965 Larson ..... 414/731

3,263,834 8/1966 La Tendresse ..... 414/731 X 3,631,995 1/1972 Jones ..... 414/731

*Primary Examiner*—Robert J. Spar

*Assistant Examiner*—Terrance L. Siemens

*Attorney, Agent, or Firm*—Sim & McBurney

[57] ABSTRACT

There is provided a grapple for lifting and maneuvring elongated items, which includes a main frame and a sub-frame, the two frames being pivotally mounted with respect to each other about a substantially vertical axis. The sub frame includes grappling jaws and heel elements which are capable of receiving elongated items. Mechanisms are provided for rotating the sub-frame with respect to the main frame. The heel is fixed with respect to the sub-frame and is spaced from the grappling jaws.

5 Claims, 4 Drawing Figures

INTEGRAL HEEL TREE LENGTH GRAPPLE

This invention relates generally to a grappling apparatus for manipulating trees, poles, or other elongated objects, and has to do more particularly with a grappling apparatus of simplified construction which nonetheless is capable of a full range of manoeuvres.

BACKGROUND OF THIS INVENTION

Grappling devices for trees and the like have been developed and are familiar to those versed in the pulp and paper industry. However, the prior art grappling apparatus tends to be complex and therefore costly, owing partly to the fact that the prior art apparatus has been designed to permit a full 360° swivel of the grappling portion of the apparatus. Exemplary of the prior art is the grapple shown and described in U.S. Pat. No. 3,631,995, issued to Jones and Lundberg on Jan. 4, 1972 and entitled "ROTATABLE GRAPPLE WITH INDIVIDUALLY ACTUATED OUTRIGGERS". The grapple in this U.S. patents includes two downwardly depending grapple arms or tongs capable of closing together on a bunch of trees, poles or the like in a first vertical plane, together with two heel-like outriggers each having a downwardly diverging fork with the two outrigger forks lying in planes on either side of the tong plane and spaced therefrom. The outriggers are capable of being moved upwardly or downwardly with a swivel action with respect to the central frame from which the tongs or grapple arms depend. Because the entire lower assembly which includes the grapple arms and the outriggers is able to swivel through 360°, a certain complexity of design is introduced, in which the hydraulic lines must pass through an open hollow passageway in the centre of the swivel arrangement so that excessive uni-directional swivelling will not bind or tangle the hydraulic lines. Additionally, the interposition of a swivel assembly between the boom connection and the lower frame to which the grapple arms and the outriggers are attached requires a considerable vertical height for the assembly as a whole, which can be a disadvantage in certain manoeuvring situations.

Finally, the grapple disclosed in U.S. Pat. No. 3,631,995 is intended to pick up trees, polls, etc. at approximately the centre of gravity thereof, and therefore requires vertically manoeuvrable outriggers in order to secure a tight grip on the bunch of trees etc. which is picked up. However, it has now been found that it is possible to eliminate one of the outriggers or heels, and to permit the remaining heel to be fixed and unmoving, so long as the bunch of trees, poles, etc. is grasped in a certain region with respect to the centre of gravity thereof.

GENERAL DESCRIPTION OF THIS INVENTION

Accordingly, this invention provides a grapple for lifting and manoeuvring trees, poles and the like, which includes tree grappling means and a heel which is spaced from the grappling means. In a preferred embodiment, the heel has a downwardly forked structure permitting it to receive the bodies of the elongated items which are also grasped by the grapple. By seizing the elongated items away from the centre of gravity of the items, with the heel being on the side of the grapple which is remote from the centre of gravity of the items being picked up, the items will be pressing upwardly against the heel and downwardly against the grapple means, to provide a two-point grip of relative stability.

More particularly, this invention provides a grapple for lifting and manoeuvring elongated items. The grapple includes a main frame mounted for pivoting about a substantially horizontal first pivot axis, and a sub-frame pivotally and hingeably mounted to the main frame about a second axis which is substantially vertical when the grapple is in operative position, at least a portion of the sub-frame being horizontally adjacent the main frame when the second axis is vertical. The pivoting of the sub-frame with respect to the main frame is limited to an angle less than 360° due to mechanical interference between the main frame and the sub-frame, whereby the vertical dimension of the grapple is minimized. Tree-grappling means are provided on the sub-frame, with first power means for operating the tree-grappling means. A sprocket is fixed to the main frame in a plane perpendicular to the second axis, the sprocket being concentric with the axis. A pinion is mounted rotatably on the sub-frame and is located in the same plane as the sprocket. Second power means are provided for rotating the pinion with respect to the sub-frame in either direction selectively, and an endless chain is entrained around the sprocket and pinion, whereby rotation of the pinion causes the sub-frame to swivel with respect to the main frame. Non-articulating heel means are rigid with the sub-frame and spaced from the tree-grappling means, the heel means including an inverted fork structure in which the elongated items can lodge.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
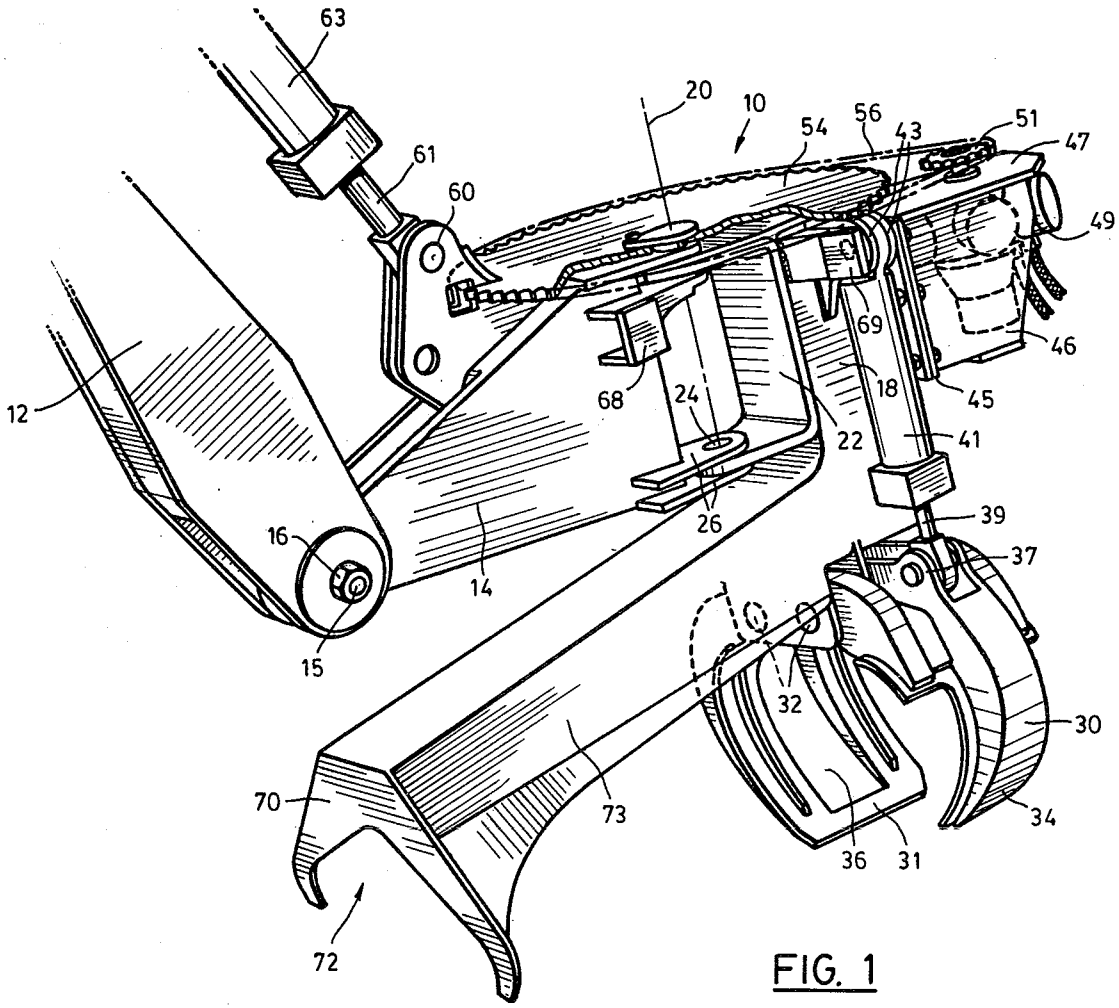
FIG. 1 is a perspective view of a grapple for livting and manoeuvring elongated items.

Attention is first directed to FIG. 1, which shows a grapple 10 for lifting and manoeuvring elongated items such as trees, poles, and the like. The grapple 10 is mounted at the end of a boom 12, and includes a main frame 14 triangularly shaped in elevation, the main frame 14 being pivoted to the end of the boom 12 at one of the apices of the triangular elevational shape. A shaft 15 defines the pivot axis, with two nuts 16 (only one visible in FIG. 1) holding the shaft 15 in place. The shaft 15 is threaded at its extremities to receive the nuts 16. Pivotally mounted to the main frame 14 is a sub-frame 18. The main frame and the sub-frame 18 pivot with respect to each other about a substantially upright pivot axis represented by the broken line 20 in FIG. 1. To accomplish the pivotal connection between the two frames, a U-shaped bracket 22 is secured to the sub-frame 18, the arms of the U-shaped bracket 22 having openings adapted to receive stub shafts 24 (only one visible in FIG. 1). The main frame 14 has, at the top and the bottom, double plates 26 which receive the arms of the U-shaped bracket 22. The double plates 26 are also apertured to receive the stub shafts 24. The stub shafts 24 are in alignment, and thus define a pivot axis 20.

Mounted to the sub-frame 18 is a tree-grappling means including first and second grapple arms 30 and 31, the grapple arms 30 and 31 being pivotally mounted by means of rivets 32 and a further pair of rivets at the far surface of the grapple arms 30 and 31 as pictured in FIG. 1 (the other rivets not visible in the figure). The grapple arm 30 has a narrow grappling portion 34 which is adapted to fit within an opening 36 in the wider grapple arm 31. Each grapple arm 30 and 31 defines a pair of upstanding flanges 37 for the attachment of the end of a piston 39 of a hydraulic cylinder 41, the other end of the hydraulic cylinder 41 being pivotally connected between two brackets 43 fixed to the sub-frame 18. Thus, actuation of each hydraulic cylinder 41 (only one of these being visible in FIG. 1) will cause its respective grapple arm 30, 31 to move either toward or away from the other.

Fixed to the rightward end of the sub-frame 18 is a brace plate 45 which supports two side plates 46 and a top plate 47 that define a housing for a hydraulic motor 49. The hydraulic motor 49 rotates a shaft on which is mounted a pinion gear 51 adapted to be engaged by an endless chain similar to a bicycle chain.

Fixedly secured to the main frame 14, and above the same, is a sprocket gear 54 which is large in comparison to the pinion gear 51. The sprocket gear 54 is coaxial with the pivot axis 20, and is in a plane perpendicular to that pivot axis 20 (as in the pinion gear 51). An endless chain 56 is entrained around both gears 51 and 54 with negligible slack, whereby, when the hydraulic motor 49 rotates the pinion gear 51, the latter "walks" around the sprocket gear 54, thus causing the sub-frame 18 to pivot in a controlled manner with respect to the main frame 14. The hydraulic motor 49 can rotate the pinion gear 51 in either direction, thus allowing the operator full control over the orientation of the sub-frame 18 with respect to the main frame 14.

The main frame 14 has a double bracket 60 adapted to be pivotally connected to the end of a piston 61 of a hydraulic cylinder 63 of which the other end (not seen) is connected to the boom 12. Thus, actuation of the hydraulic cylinder 63 will cause the main frame 14, and thus the sub-frame 18, to pivot in a substantially vertical plane about the axis defined by the centre line of the shaft 15.

Because the main frame 14 and the sub-frame 18 are pivoted together somewhat in the manner of a door hinge, rather than being separated from each other along the pivot line, it is not possible for the one part to swivel full circle with respect to the other. Mechanical interference takes place, just as with a door hinge, and thus the arc through which the sub-frame 18 can travel with respect to the main frame 14 is something less than 360°.

As will later appear, it is not necessary, for all practical purposes of the grapple, to swivel the sub-frame 18 through more than about 200° or 220° with respect to the main frame 14, in order to allow full functionality and a complete range of operating capability. The advantage which arises from the structure shown in FIG. 1 relates not only to the simplicity of the design, and thus lower cost, but also to the fact that the grapple assembly occupies the least amount of vertical distance taken in the direction of the pivot line 20.

In order to positively limit the arc through which the sub-frame 18 travels with respect to the main frame 14, two sets of limit stops are provided, only one being seen in FIG. 1 and identified by the numerals 68 and 69. These stops are in the form of square plates, supported from the main frame 14 and the sub-frame 18, respectively, by suitable brackets which need not be described in detail.

As can be seen in FIG. 1, the sub-frame 18 includes a heeel 70 which defines an inverted fork structure 72 and which is located at the end of an elongated arm 73 forming an integral part of the sub-frame 18. Because of the elongated arm 73, the heel 70 is spaced some distance from the grapple arms 30 and 31, and the advantage of this structure will be apparent from what follows.

Figure 2:
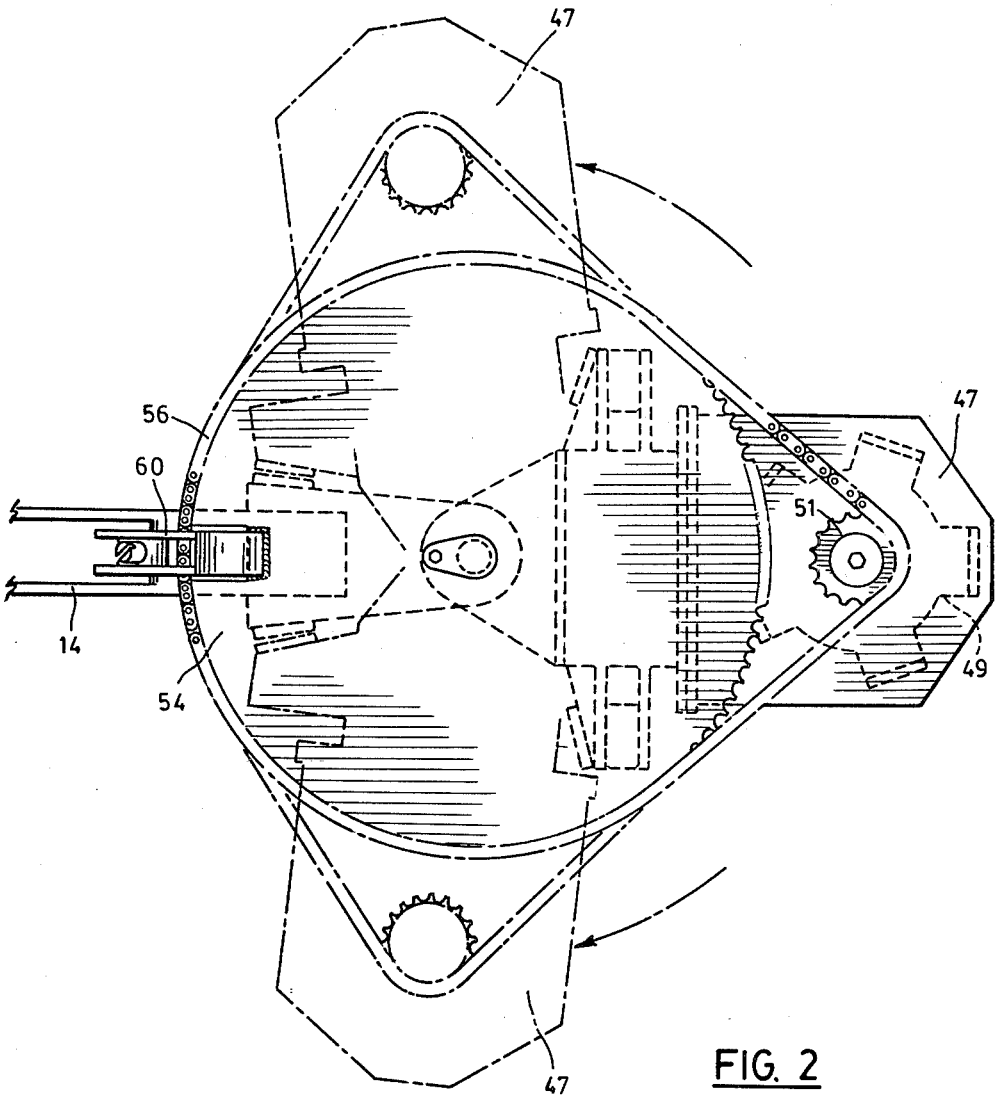
FIG. 2 is a plan view of part of the grapple illustrated in FIG. 1.

Attention is now directed to FIG. 2, which illustrates the extreme positions of the sub-frame 18 with respect to the main frame 14. This is shown by illustrating the outline of the top plate 47 in a central position (solid lines), and in two extreme side positions (broken lines).

Figure 3:
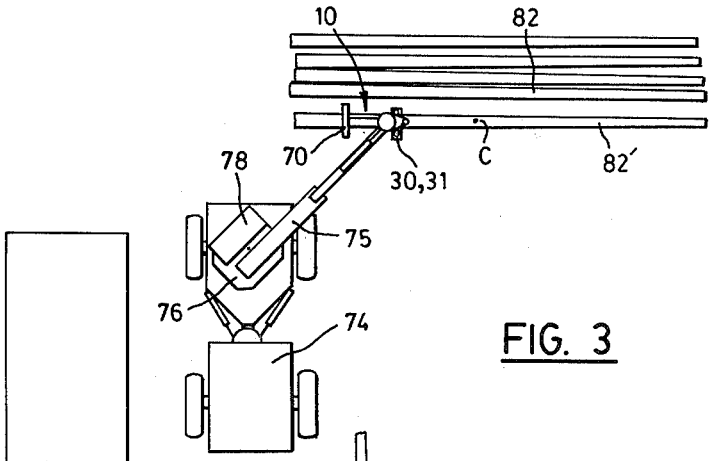
FIGS. 3 and 4 are plan views, to a small scale, showing sequential stages in the use of the grapple of this invention.

Attention is now directed to FIG. 3, which shows the first of a sequence of steps when utilizing the grapple herein disclosed. In FIG. 3, a vehicle 74 is provided with a swivel boom 75 mounted on a swivel carriage 76, which also carries a cab 78. The vehicle 74 is oriented for travel along a roadway which is parallel with a hauling truck 80 also seen in FIG. 3. The task of the vehicle 74 is to grasp one or more of the poles seen lying in a pile 82 in FIG. 3, and to load the poles onto the truck 80 in alignment therewith. As can be seen in FIG. 3, the poles 8 are lying perpendicular to the roadway with which the hauling truck 80 is aligned. The first step, as seen in FIG. 3, is to grasp one of the poles (identified as 82') with the grapple, and to do so at a location which is spaced from the centre of gravity C of the pole 82'. A further requisite is that the heel 70 of the grapple 10 be located on the other side of the grapple arms 30, 31 from the centre of gravity C. This has been illustrated in FIG. 3, and it will be appreciated that the pole 82' will be suspended, when raised, in such a way that the pole 82' presses downwardly against the grapple arms 30, 31 and presses upwardly against and into the heel 70. This "two-point" grip on the pole 82', using its own weight to make the grip more secure, suffices to allow the grapple 10 to manoeuvre the pole safely while suspended in the air.

Figure 4:
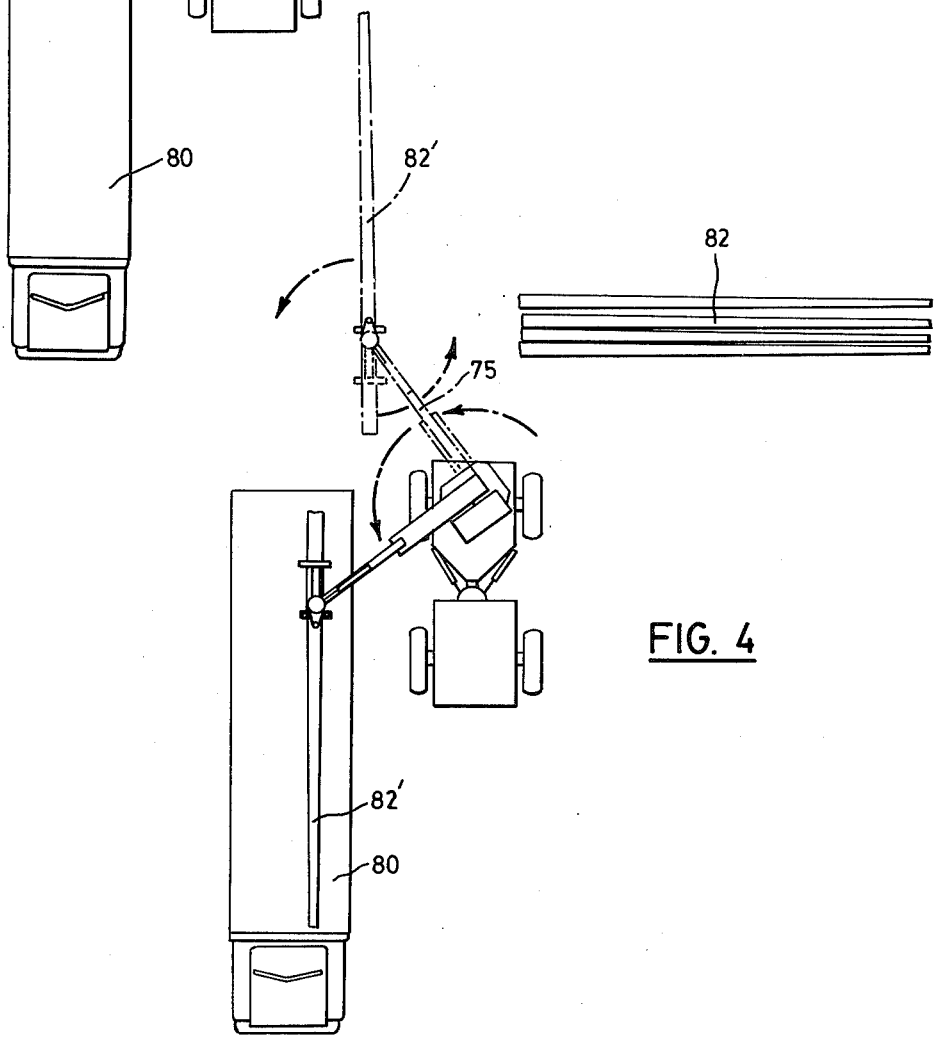

FIG. 4 shows, in broken line, a mid-position for the pole 82', with the boom 75 swung about 90° counterclockwise as seen in the figure, without the pole 82' having been swivelled with respect to the boom 75. At this point, the hydraulic motor 49 is actuated in order to swivel the sub-frame 18 through approximately 90° with respect to the main frame, while at the same or a different time the boom 75 is carried through an additional 90° in the counterclockwise sense. (The pole 82' also swivels in the counterclockwise sense.) The result of this motion will be a swivelling of the pole 82' through the sum of the two swivelling motions, namely 90° plus 90° equals 180°, so that the pole 82' ends up in alignment with the hauling truck 80, after having rotated through a total arc of about 270°. However, this manoeuvre has required the sub-frame 18 to swivel through an arc of only about 90° with respect to the main frame 14. It is thus seen that considerable usefulness and manoeuvrability is provided, without requiring a large arc for the sub-frame to swing with respect to the main frame.

While a specific embodiment of the invention has been illustrated and described in this specification, it will be apparent to those skilled in the art that modifications and changes may be made therein without departing from the scope of the invention as set forth in the appended claims.

We claim:

1. A grapple for lifting and manoeuvring elongated items, comprising:

a main frame mounted for pivoting about a substantially horizontal first pivot axis, a sub-frame pivotally and hingeably mounted to the main frame about a second axis which is substantially vertical when the grapple is in operative position, at least a portion of the sub-frame being horizontally adjacent the main frame when the second axis is vertical, the pivoting of the sub-frame with respect to the main frame being limited to an angle less than 360°, due to mechanical interference between the main frame and the sub-frame, whereby the vertical dimension of the grapple is minimized, tree-grappling means on the sub-frame, with first power means for operating the tree-grappling means, a sprocket fixed to the main frame in a plane perpendicular to said second axis, the sprocket being concentric with said axis, a pinion mounted rotatably on the sub-frame and located in the same plane as the said sprocket, second power means for rotating the pinion with respect to the sub-frame in either direction selectively, an endless chain entrained around the sprocket and pinion, whereby rotation of the pinion causes the sub-frame to swivel with respect to the main frame, and non-articulating heel means rigid with the sub-frame spaced from said tree-grappling means and including an inverted fork structure in which the elongated items can lodge.

2. A grapple as claimed in claim 1, in which the tree grappling means extends downwardly from the sub-frame on one side of the second axis, the heel means extending to the other side of the second axis.

3. A grapple as claimed in claim 2, in which both power means are hydraulically operated.

4. A grapple as claimed in claim 1, claim 2 or claim 3, in which the main and sub-frames have swivel limit stops to establish the maximum angle of swing of the sub-frame with respect to the main frame.

5. A grapple as claimed in claim 1, claim 2 or claim 3, in combination with a vehicle having a swing boom to the end of which the grapple is mounted at said first pivot axis, there being provided third power means for pivoting the main frame about said first pivot axis with respect to the swing boom.

* * * * *